US005826915A

United States Patent [19]

Gregory, Jr.

[11] Patent Number: 5,826,915

[45] Date of Patent: Oct. 27, 1998

[54] METHOD OF USING THERMOCHROMIC MATERIAL ON SECURITY DOCUMENTS AND PRODUCT

[75] Inventor: Vance P. Gregory, Jr., Wheaton, Ill.

[73] Assignee: Wallace Computer Services, Inc., Lisle, Ill.

[21] Appl. No.: 432,612

[22] Filed: May 1, 1995

Related U.S. Application Data

[63] Continuation-in-part of Ser. No. 390,032, Feb. 17, 1995.

[51] Int. Cl.[6] ..... B42D 15/00

[52] U.S. Cl. ..... 283/67; 283/70

[58] Field of Search ..... 283/114, 74, 72, 283/95, 75, 117, 901, 902, 904, 57, 58, 67, 70; 359/288

[56] References Cited

U.S. PATENT DOCUMENTS

| | | | |
|---|---|---|---|
| 4,944,450 | 7/1990 | Schmidt . | |
| 5,193,854 | 3/1993 | Borowski, Jr. et al. . | |
| 5,209,513 | 5/1993 | Batelli et al. | 283/114 X |
| 5,281,570 | 1/1994 | Hasegawa et al. . | |
| 5,282,651 | 2/1994 | Alonso . | |
| 5,338,067 | 8/1994 | Gundjian | 283/67 |
| 5,533,759 | 7/1996 | Jeffers | 283/82 |
| 5,536,046 | 7/1996 | Chang | 283/114 X |

FOREIGN PATENT DOCUMENTS

| | | |
|---|---|---|
| 2188283 | 3/1986 | United Kingdom . |

*Primary Examiner*—Willmon Fridie, Jr.
*Attorney, Agent, or Firm*—Tilton, Fallon, Lungmus & Chestnut

[57] ABSTRACT

A method of document security comprising providing a substrate having a spot of thermochromic material printed thereon capable of undergoing a reversible color change upon exposure to heat, associating alpha instructional information with the spot, reproducing the alpha information on a second substrate, and subjecting the second substrate to heat to determine whether the document is original or authentic.

13 Claims, 1 Drawing Sheet

PLACE FORM ON A FLAT SURFACE. RUB AREA FIRMLY & RAPIDLY STRIPE

SAFETY FEATURE SAFETY FEATURE SAFETY FEATURE SAFETY FEATURE

MUST DISAPPEAR & REAPPEAR FOR DOCUMENT TO BE AUTHENTIC

METHOD OF USING THERMOCHROMIC MATERIAL ON SECURITY DOCUMENTS AND PRODUCT

This application is a continuation-in-part of application Ser. No. 390,032 filed Feb. 17, 1995, now U.S. Pat. No. 5,536,046.

BACKGROUND AND SUMMARY OF INVENTION

This invention relates to method of using thermochromic material on security documents and product and, more particularly, a method and product which utilizes thermochromic material to check the originality or authenticity of a document.

Thermochromic materials are well known—see, for example, U.S. Pat. No. 5,281,570 and U.K. Publication 2 188 283. These have been used on trading cards, lottery tickets and the like—see, for example, U.S. Pat. Nos. 5,193,854 and 5,282,651. The '854 patent also discloses imprinting a covered thermochromic layer on a negotiable instrument to indicate authenticity as compared to a copy.

The invention here in its broadest aspect includes a method of document security wherein we provide a substrate having a spot of thermochromic material roll having printing thereon capable of undergoing a reversible color change upon exposure to heat, reproducing the printing on a second substrate, and subjecting the second substrate to heat to determine whether the document as been reduced. It also includes the method and product wherein alpha instructional information is associated with the spot of thermochromic material to convey to the person inspecting the document the method of checking originality. The alpha information may be adjacent the spot or under the spot in whole or in part.

More particularly, the invention contemplates the printing of the security document, a check for example, by roll printing such as offset or flexographic printing and also roll printing the thermochromic spot or similar design.

Other objects and advantages of the invention may be seen in the ensuing specification.

BRIEF DESCRIPTION OF DRAWING

The invention is described in the accompanying drawing, in which

FIG. 2 is an enlargement of an encircled portion of

FIG. 1 to detail a suitable legend;

DETAILED DESCRIPTION

In the illustrated embodiment, the numeral 10 designates generally a substrate which advantageously may be a security document such as a check. The document can be constructed of paper, film or various similar materials and can take the form of a label, an instruction document, a check, etc. but involving information thereon which is sensitive to theft, alteration and especially forgery as by copying.

The substrate 10 is equipped with a spot or layer 11 of thermochromic material and which advantageously can incorporate a legend such as:

Safety Feature

Place form on flat surface, rub area firmly and rapidly stripe

Must disappear and reappear for document to be authentic.

Figure 2:
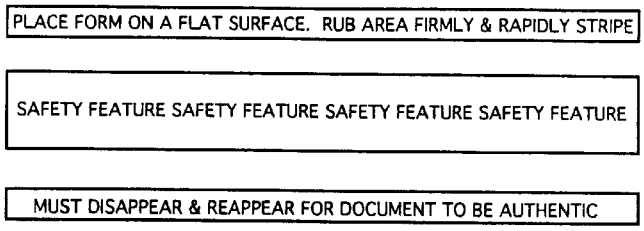
Figure 6:
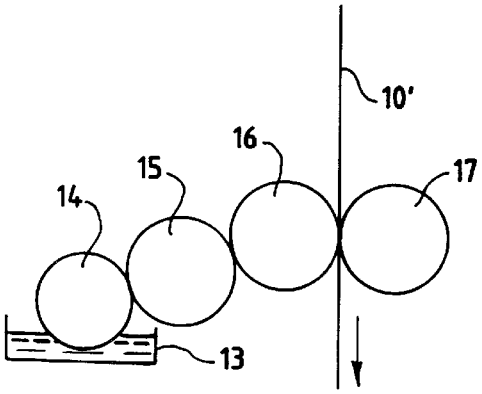
FIG. 6 is a side elevation of flexographic printing apparatus useful in the practice of the invention.
Figure 7:
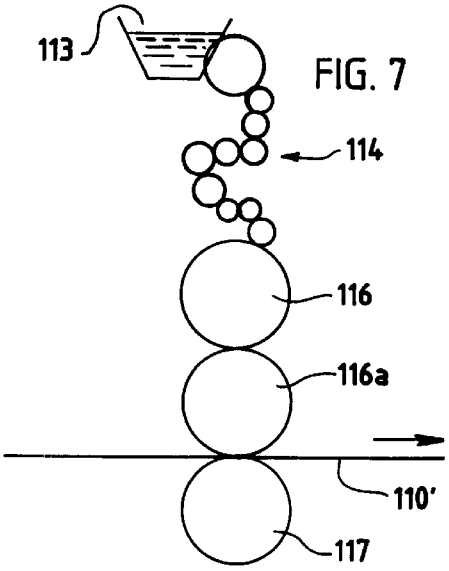
FIG. 7 is a view similar to FIG. 6 but of offset printing apparatus also useful in the practice of the invention.

As illustrated in FIG. 2, this legend can be accompanied by the thermochromic material which is obtainable under product designation Thermochrome from SICPA Securink Corp. located in Springfield, Va. This is especially advantageous in flexographic printing as illustrated in FIG. 6. A suitable thermochromic ink for offset printing a product designation DYNAHEAT available from Chromatic Technologies, Inc. located in Ithaca, N.Y. This is illustrated in FIG. 7.

Figure 3:
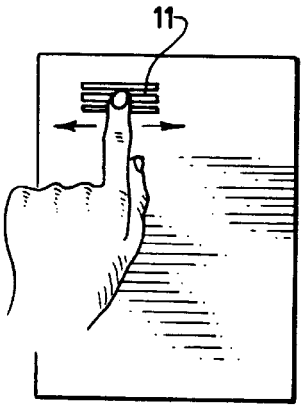
FIG. 3 is a view similar to FIG. 1 but somewhat reduced and illustrating the document being subjected to heat as by rubbing.
Figure 4:
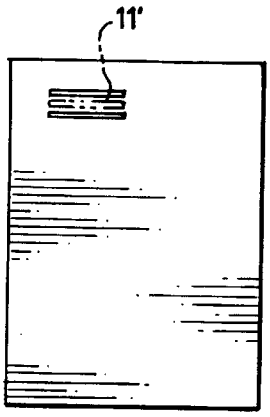
FIG. 4 is a view similar to FIG. 3 but at a later stage in the manipulation and showing the alteration as by disappearing of the thermochromic spot.
Figure 5:
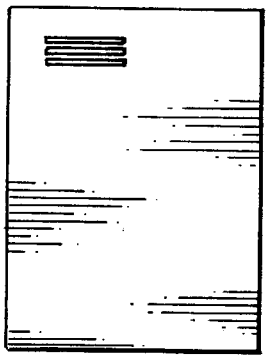
FIG. 5 is a view similar to FIGS. 3 and 4 but later in the sequence of manipulation wherein the alteration of the thermochromic spot has reverted to original form.

The method of use of the invention is illustrated in FIGS. 3–5 where the thermochromic spot is again designated by the numeral 11. In FIG. 3, the numeral 12 designates an object performing a rubbing action on the spot 11 which can be the forefinger of a person or any other implement suitable for creating heat through frictional engagement. In FIG. 4, it will be noted that there is virtual disappearance of the spot 11 as at 11' but which is shown by a broken line outline which also could be a change in the color as contrasted to partial or complete disappearance.

Figure 1:
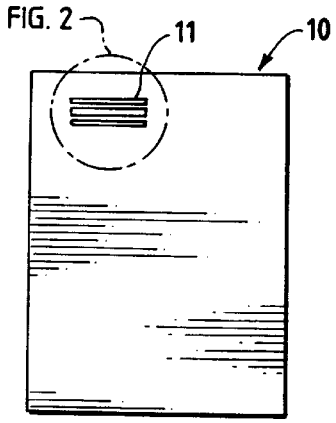
FIG. 1 is a top plan view of a document incorporating teachings of the invention.

Then in FIG. 5, the spot 11 is seen to revert via lapse of time and cooling to its original character as depicted in FIG. 1 and which may be a return of the original color or the original shape if there has been a disappearance.

As indicated above, the thermochromic ink spot 11 is capable of being applied in various roll manners but especially advantageous is either flexographic or offset printing. In flexographic printing as illustrated in FIG. 6, a source of ink such as a fountain 13 has an ink pickup roll 14 which applies a layer of ink to an anilox roll 15 while metering the thickness of ink thereon. The ink from the anilox roll 15 is transferred to a plate roll 16 for application to a web 10' being supported in the nip between the plate roll 16 and the impression roll or cylinder 17.

Alternatively, the pattern or spot 11 may be put down by offset printing as illustrated in FIG. 7. There, the numeral 113 designates an ink fountain or other source of thermochromic ink which then is applied through a series of rolls generally designated 114 so as to develop a prescribed thickness or layer of the ink film for ultimate application to a plate cylinder 116. In turn, the plate cylinder ink film is transferred to a blanket cylinder **116*a* and thereafter to a web 110', the web being moved through the nip between the blanket cylinder 116*a* and the impression cylinder 117**.

In summary, the invention makes use of printing of various types such as flexographic or offset as a method of applying thermochromic inks to paper, labels and films. More specifically, the invention makes use of flexographic thermochromic inks in forms and labels that can be imaged in laser printers, both sheeted and continuous. The output of the printers of either FIG. 6 or FIG. 7 can, at an adjacent or a remote site, be subjected to laser printing in the manner shown in co-owned U.S. Pat. No. 4,944,450. Impact printing may also be used. The invention is particularly advantageous in preventing the forgery of documents as by attempted copying—very often through xerographic procedures. The art has advanced substantially in color xerography so that there is great fidelity in color reproduction. Thus, a would-be forger can develop documentation that appears to be the same as the original but through the practice of the invention this is frustrated by the procedure of applying heat as by friction or other instrumentality and noting the lack of color change in the thermochromic pattern—thereby warning the viewer of a forged document.

While in the foregoing specification a detailed description of the invention has been set down for the purpose of illustration, many variations in the details given above may be made without departing from the spirit and scope of the invention.

I claim:

1. A method of assuring originality of security document comprising the steps of providing a substrate having a spot of thermochromic material thereon capable of undergoing a reversible color change upon exposure to heat, associating alpha instructional information with said spot, printing security information on said substrate by a first party, transferring possession of said substrate so as to afford the opportunity of enabling said document and information thereon to be reproduced on a second substrate by a second party, noting said information by a third party in privity with said first party and subjecting said second substrate to heat to determine whether the document is original or authentic.

2. The method of claim 1 in which said spot changes color.

3. The method of claim 1 in which said spot becomes colorless.

4. The method of claim 1 in which said spot includes an instructional legend at least partially thereunder or adjacent thereto.

5. The method of claim 4 in which the legend specifies that upon rubbing the layer must alter and return to original form for the said document to be the original.

6. The method of claim 1 in which said steps include applying said spot by flexographic printing.

7. The product made according to the method of claim 6.

8. The method of claim 1 in which said steps include providing said layer by off-set printing.

9. The product made according to the method of claim 8.

10. The method of claim 1 in which said steps include providing said heat by frictional engagement.

11. A method of assuring originality of a security document comprising the steps of providing a substrate, roll printing thereon a spot of thermochromic material capable of undergoing a reversible color change upon exposure to heat, associating alpha instructional information with said spot, printing security information on said substrate at a fist site, issuing said substrate and incident thereto enabling said document and information thereon to be reproduced on a second substrate, transferring said substrate to a second site in privity with said first site, noting said information and subjecting said second substrate to heat to determine whether the document is original or authentic.

12. The method of claim 11 in which said steps include roll printing by either flexographic printing or off-set printing.

13. The method of claim 11 in which said step of printing security information includes printing by either a laser printer or an impact printer.

* * * * *

UNITED STATES PATENT AND TRADEMARK OFFICE

CERTIFICATE OF CORRECTION

PATENT NO. : 5,826,915

DATED : October 27, 1998

INVENTOR(S) : Vance P. Gregory, Jr.

It is certified that error appears in the above-identified patent and that said Letters Patent is hereby corrected as shown below:

On the title page, item [19] inventor should be - -Gregory, Jr. et al.- - and item [75] should be - -Inventors: Vance P. Gregory, Jr., Wheaton, Ill.; John C.H. Chang, Naperville, Ill. - -

Signed and Sealed this

Twenty-second Day of June, 1999

*Attest:*

Q. TODD DICKINSON

*Attesting Officer*

*Acting Commissioner of Patents and Trademarks*